United States Patent [19]

Durand

[11] Patent Number: 4,521,652

[45] Date of Patent: Jun. 4, 1985

[54] VISUALLY AND MECHANICALLY TESTABLE SUBMERSIBLE COMPOSITE

[76] Inventor: John E. Durand, 27441 Ganso, Mission Viejo, Calif. 92691

[21] Appl. No.: 547,938

[22] Filed: Nov. 2, 1983

[51] Int. Cl.[3] ..... H01H 35/18

[52] U.S. Cl. ..... 200/84 B; 73/40; 116/DIG. 8; 200/302.1; 340/605

[58] Field of Search ..... 200/84 R, 84 A, 84 B, 200/84 C, 230, 302.1, 302.2, 302.3, 308; 73/40; 340/605; 116/227, 228, 229, 230, 270, DIG. 7, DIG. 8

[56] References Cited

U.S. PATENT DOCUMENTS 843,276 2/1907 Irish ..... 200/84 R X 2,534,830 12/1950 Philo ..... 73/40

*Primary Examiner*—A. D. Pellinen

*Assistant Examiner*—Morris Ginsburg

*Attorney, Agent, or Firm*—Robert L. Sassone

[57] ABSTRACT

A visually and mechanically testable float switch composite is presented. The composite had a casing having one opening into a switch cavity containing a switch having leads potted to the outside. A float is coupled through the opening by coupling means to mechanically actuate the switch. The opening is closed by a bearing and bearing cap surrounded by and sealed by an elastomeric boot. Closing of the cap increases pressure on the fluid in the switch cavity thereby causing the boot to expand like a balloon thereby permitting visual or mechanical testing since the boot remains expanded if there is no leak. In like manner, any submersible component may be made visually and mechanically testable by inserting a cap thereby increasing the internal pressure and monitoring a balloon like expandable boot to determine whether the increase in pressure is maintained.

3 Claims, 2 Drawing Figures

VISUALLY AND MECHANICALLY TESTABLE SUBMERSIBLE COMPOSITE

BACKGROUND OF THE INVENTION

1. Field of the Invention

The present invention relates to float switches.

2. Description of the Prior Art

A wide variety of float switches are known to the prior art. Practically every toilet has a mechanical float switch. The present invention relates to electrical float switches which generate one or more selected electric signals as a function of liquid level. Typical examples include float switches in boats which activate pumps when the fluid level in the hull reaches a selected triggering level such as the type that applicant received a patent U.S. Pat. No. 3,621,168 on about 15 years ago.

Float switches are usually used in or near a water environment. Since water frequently has an adverse effect on electrical switches, great pain has been taken to isolate the electronics from the water environment. Unfortunately, such switches must work for a period of years in a water related environment, and the great length of time permits the water in a certain small percentage of cases, probably less than one percent, to cause the water to adversely effect switch operation. While 99+ percent sounds pretty good for reliability, this is small consolation to you if you happen to be an unlucky guy whose boat sank because the pump did not come on because the float switch finally gave out after three years or ten years or some other length of time. There has been no way up to the present of designing a float switch which could be easily checked to determine if it was going to give out in the near future.

Most of the switch failures could be predicted if one could predict that water was going to get into the switch cavity, come in contact with the switch sometime in the near future or if one could predict that it had already happened. Modern switches can withstand a certain amount of moisture in their vacinity, but if water gets into the switching environment the chance of failure is greatly multiplied.

The present invention comprises a visually testable float switch including testing means which remain in an expanded configuration when there is no leak between the external fluid environment and a switching cavity, which testing means switch to on unexpanded configuration when there is a leak between the fluid environment and the switching cavity. A simple glance at the switch permits the viewer to detect if there has been any change in the testing means which in turn acts as a good predicter of most switch failures. Various types of electric pickups can electronically monitor whether the expansion of the visual testing means is still present thereby indicating that no leak has occurred. The present system is particularly useful in quality control after manufacture of float switches, since the float switches need only be left alone for a little while and if defects as small as porosity defects permit leakage between the switch cavity and the external environment, they can be detected. Since air is so much more permeable than liquid, the retaining of air for a substantial period of time is a good indication of the fluid tight integrity of the switch, thereby alleviating prior art float switch quality control problems such as the near impossibility to predict which float switch will fail to work ten years in the future.

It is believed that the present invention is the first inexpensive system to really safeguard that difficult transition point where the float coupling means enters the switch container since the float coupling means must move as a function of liquid level, thereby making sealing more difficult.

Obviously, the same general technique used for a switch can be used to detect a leak into any submersible container, so the present invention has wider application than just merely float switches.

SUMMARY OF THE INVENTION

A visually and mechanically testable float switch composite is presented. The composite comprises a switch casing having an interior surface defining a fluid filled switch cavity and only one opening into the switch cavity which is defined as a cap orifice. The switch casing has padded leads electrically coupled therethrough from the switch cavity to the exterior of the casing. A switch is coupled to a surface defining the switch cavity and has electrical leads, previously described, potted to the outside of the switch cavity.

A prior art float determines liquid level. Float coupling means couple the float to the switch to mechanically actuate and control the switch via the cap orifice.

A cap is used to fill the cap orifice. The cap has disposed therein a coupling bearing disposed around a cross section of the float coupling means. The cap is inserted into and substantially filled the cap orifice in a substantially fluid tight coupling. It is not too difficult to make such a coupling fluid tight since there is no motion between the cap and the cap orifice. Inserting the cap into the cap orifice increases the pressure on the fluid, which is usually air, in the switch cavity when the cap is inserted.

Visual and mechanical test means are coupled around the coupling bearing and the float coupling means. The test means comprise an elastomeric boot and remain in an expanded configuration when there is no leak between the switch cavity and the environment. The configuration of the boot changes to an unexpanded configuration when there is a leak between the switch cavity and the environment. Insertion of the cap into the cap orifice increases the pressure inside the switch cavity by displacing more air or other fluid into the switch cavity.

The boat is disposed around the coupling bearing and has an interior surface sealed to the float coupling means to prevent fluid from passing the elastomeric boot and the float coupling means. The boot has an exterior surface coupled to the interior surface of the bearing cap to prevent fluid from passing between the elastomeric boot and the bearing cap. In this example, the interior surface is at one end of the boot and the entire interior surface around that end is fixedly and fluid tightly coupled to the entire surface of a portion of the float coupling means. The exterior surface is at the opposite end of the boot in the present example and the entire exterior surface around the boot is coupled to the entire interior surface of the cap orifice. Accordingly, after a short period of time the pressure inside the switch cavity is the same as the pressure inside the elastomeric boot which is adjacent to that portion of the float coupling means just outside of the cap orifice because fluid is permitted to pass between the switch cavity and that portion of the interior defined by the interior surface of the elastomeric boot which is outside of the cap orifice. Accordingly, when the pressure inside the switch cavity exceeds atmospheric pressure or the pressure of the outer environment, the outside portion of the elastomeric boot expands. Since the pressure inside the switch cavity is caused to increase by insertion of the cap, immediately after the cap is inserted that portion of the elastomeric boot which is visible expands somewhat like a balloon. If there is no substantial leak, the boot remains expanded indicating that this particular switch composite is substantially leak proof.

While the primary purpose of the present invention involves composite submersible switches, other submersible devices could also be protected by the present invention. The switch casing could be an electric device casing containing any type of electric device and having a casing cavity. The float coupling means could comprise a float arm and pivot arm, but the invention could be used for a device not involving a float. The cap which is disposed around a gas permeable bearing in the first example could involve a variety of applications so long as there was an opening to which an elastomeric boot or the equivalent could be coupled to permit visual and mechanical indication of differences in pressure between the interior of the casing cavity and the external environment.

DRAWING DESCRIPTION

Reference should be made at this time to the following detailed description which should be read in conjunction with the following drawing of which:

FIG. 1 is a side view of a portion of an example of the present invention; and FIG. 2 is a partially cut away side view of a portion of the invention

DETAILED DESCRIPTION

Figure 2:
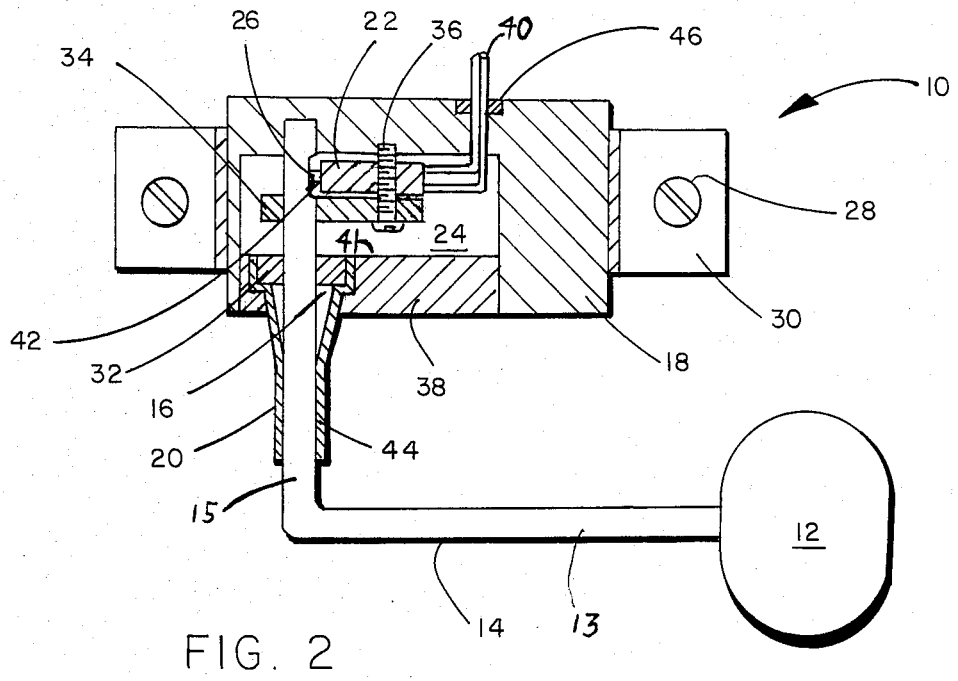
Figure 1:
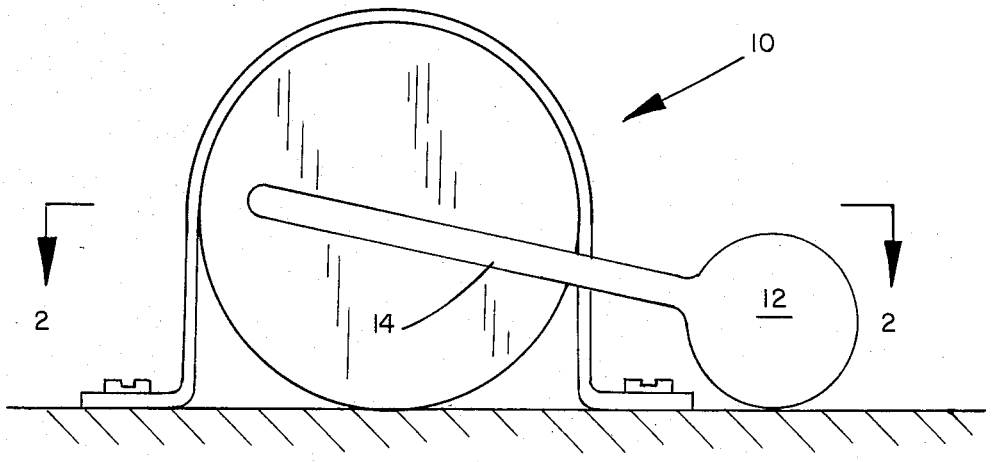

Reference should be made at this time to FIGS. 1 and 2 which illustrate an example of the visually and mechanically testable float switch composite 10 according to the present invention. The composite 10 comprises a float 12 coupled by float coupling means 14 to a switch 22. The coupling means may or may not comprise a float arm 13 which is as shown in the drawings coupled to a pivot arm 15.

A switch casing 18 having an interior surface defining a fluid filled switch cavity 24 and only one opening into the switch cavity 24 which is a cap orifice 41. Potted leads 40 couple a switch 22 electrically to the outside of the switch casing 18. The switch 22 is coupled to an interior surface of the switch casing 18 and is completely surrounded by the switch cavity 24 so as to be cut off from the external environment which environment may become wet. The switch 22 is activated in this example by a switching cam 26 known to the prior art. Movement of the float 12 causes movement of the float coupling means 14 which causes the switching cam 26 to actuate and/or control the position of the switch 22 and the output along the leads 40.

The coupling means 14 are coupled into the interior switch cavity 24 of the switch casing 18 via the cap orifice 41 and the problem is to prevent fluid from flowing through the cap orifice 41. The new method of doing this and learning whether the sealing has been successful comprises a substantial part of the present invention.

A switch cavity cap 38 has disposed therein a coupling bearing 32 disposed around a cross section of the float coupling means 14 shown as disposed around the pivot arm 15 in FIG. 2. The cap 38 is inserted into and substantially fills the cap orifice 41 in a substantially fluid tight coupling. The fluid tight coupling is easy to maintain because there is no movement between the cap 38 and interior surfaces defining the cap orifice 41 after insertion of the cap 38 into the cap orifice 41. Accordingly, any one of a substantial number of glues or bonding agents known to be prior art may be utilized so long as they are water proof or at least not destroyed by the environment into which the composite 10 is to be placed. Insertion of the cap 38 into the orifice 41 forces fluid such as air into the interior of the switch cavity 24 increasing the pressure of the switch cavity 24.

Visual and mechanical test means 20 such as an elastomeric boot 20 are coupled around the coupling bearing 32 and the float pivot arm 15 of the float coupling means 14 inserted through the pivot arm bearing 32. The test means 20 remain in an expanded configuration when there is no leak between the switch cavity 24 and the environment and change to an unexpanded configuration when there is a leak between the switch cavity 24 and the environment. If there is no leak the pressure which would increase by insertion of the cap 38 stays increased in comparison to the environment because there is no place for the additional air or other material forced into the switch cavity 24 to escape. If there is a leak, however, the air will escape and the pressure will become equalized between the environment and the interior of the switch cavity 24 so that the elastomeric boot 20 is no longer blown up slightly like a balloon, but has an unexpanded protrusion 16 as shown in FIG. 2.

Various alternate examples such as stripes (not shown) on the elastomeric boot 20 to make visual inspection easier will be obvious to those skilled in the arts. Electronic testing means such as running a current between the boot and an adjacent surface either when the boot is in an expanded configuration or when it is not can permit automatic continual tests of the composite 10. Probably the best such system would be an electric contact between the interior surface of the boot 20 which permits a current to run in the configuration shown in FIG. 2 and cuts off the current when the boot 20 is expanded (as not shown in FIG. 2) would be the best system. Running of the current could actuate an external alarm of some type. The signal could be carried out of the switch cavity through leads adjacent the leads of the switch 22 which are shown in FIG. 2. In this way a red light or other alarm could be activated on the dash panel of a boat when the switch was detected to have leaked. Alternatively, an audio alarm or an electric alarm transmitted by radio or telephone or other means could be generated. These are examples only. In most cases, the elastomeric boot 20 will have gone into the configuration shown well before a year after the switch is installed but the switch composite 10 will be liquid proof for the necessary time because air tightness for a short period of time is a good indication of liquid tightness for a substantially longer period of time. The elastomeric boot 20 is disposed around the bearing 32 and has an interior surface sealed to the float coupling means 14 pivot arm 15 toward the lower portion of the pivot arm 15 as shown on FIG. 2. This sealing by sealing means 44 such as some sort of glue or bonding or the equivalent prevents fluid from passing between the bottom portion of the boot 20 and arm 15. Fluid can pass and gas can pass through the bearing 32 from the cavity 24 to the protrusion 16 as shown in FIG. 2. The boot 20 upper surface outer surface as shown in FIG. 2 is also sealed to the adjacent interior surface of the switch cavity cap 38 to prevent fluid from passing between them. Fluid can, however, pass although at a low rate from the switch cavity 24 to that portion of the interior of the boot 20 which is shown as an open space in FIG. 2 and is adjacent or nearly adjacent to the cap 38 which is that portion of the boot 20 which is outside of the bearing 32. Accordingly, that portion of the boot 20 interior outside of the bearing 32 is going to relatively quickly come to the same pressure as the pressure inside the switch cavity 24. If the pressure inside the switch cavity 24 exceeds the pressure adjacent the outer surface adjacent the elastomeric boot which is the environmental pressure, the boot will expand like a balloon at protrusion 16.

While the primary purpose of the present invention involves composite submersible switches, other submersible devices could also be protected by the present invention. In addition, the float 12 is not a necessary part of the present invention, although the present invention is more useful where there is a float 12 because of the difficulty of sealing that portion of the casing 18 through which the float coupling means 14 passes. For such a modified device, you would merely release the float 12 and associated circuitry from the figures. You might replace the switch 22 with the other desired electric device. You would change terminology such as calling the switch casing 18 an electric device casing or other appropriate name. The switch cavity 24 would be called a casing cavity. A cap would be inserted into and substantially fill the orifice 41 thereby increasing pressure in the cavity 24 and causing the protrusion 16 of the boot 20 to expand toward the environment when the pressure in the casing cavity 24 exceeds the pressure of the environment which in turn indicates that there has been no substantial leak between the fluid in the casing cavity and the environment. The fluid would have to be a gas or compressable liquid.

A particular example has been described. Other examples of the invention would be obvious to those skilled in the art. The invention is limited only by the following claims.

What is claimed is:

1. A visually and mechanically testable submersible composite, comprising:

a switch casing having an interior surface defining a gas filled switch cavity and a cap orifice opening into the switch cavity;

a switch mechanically coupled to a surface defining the switch cavity and having electrical leads potted in a leak tight potting through the surface defining the switch cavity to the outside of the switch casing;

a float;

a float coupling means coupling the float to the switch via the cap orifice to mechanically actuate and control the switch;

a cap having an interior surface disposed around a gas permeable coupling bearing, the cap having an exterior surface substantilly identical to the interior surface of the cap orifice whereby the cap may be inserted into and substantially fill the cap orifice in a substantially gas tight coupling, thereby increasing pressure on the gas in the switch cavity when the cap is inserted; and a visual and mechanical test means having an interior surface coupled in a leak tight coupling around that portion of the float coupling means which is near but outside of the cap and having an exterior surface coupled in a leak tight coupling around the interior surface of the cap which is disposed around the gas permeable coupling bearing which is disposed around that portion of the float coupling means within the cap orifice.

2. The invention of claim 1 wherein the test means comprise an elastomeric boot disposed around the bearing and having an interior surface sealed to the float coupling means to prevent fluid from passing between the elastomeric boot and the float coupling means and having an exterior surface coupled to an interior surface of the cap orifice to prevent gas from passing between the elastomeric boot and the cap and permitting gas to pass between the switch cavity and protrusion of the boot which is outside of the casing such that the protrusion of the elastomeric boot expands if the pressure inside the switch cavity exceeds the pressure adjacent the outer surface of the elastomeric boot.

3. The invention of claim 2 wherein said elastomeric boot expands toward the environment when the pressure in the switch cavity exceeds the pressure of the environment which in turn indicates that there has been no substantial leak between the gas in the switch cavity and the environment.

* * * * *